US006019740A

United States Patent [19]

Hausman

[11] Patent Number: 6,019,740

[45] Date of Patent: Feb. 1, 2000

[54] ACTUATOR DRIVEN STRETCHING AND EXERCISE DEVICE

[76] Inventor: John M. Hausman, 2669 Wilbur Rd., Medina, Ohio 44256

[21] Appl. No.: 08/994,409

[22] Filed: Dec. 19, 1997

[51] Int. Cl.[7] ..... A61H 1/02; A61H 21/00

[52] U.S. Cl. ..... 601/24; 601/26; 601/35; 482/907

[58] Field of Search ..... 601/5, 23, 24, 601/26, 33–35, 98, 100; 482/4, 9, 95, 96, 131, 133, 134, 139, 142, 148, 907; 606/241

[56] References Cited

U.S. PATENT DOCUMENTS

| | | | |
|---|---|---|---|
| 3,307,534 | 3/1967 | Gibbs | 482/142 |
| 3,876,198 | 4/1975 | Seligman | 601/26 |
| 4,651,719 | 3/1987 | Funk et al. . | |
| 4,669,451 | 6/1987 | Blauth et al. . | |
| 4,716,889 | 1/1988 | Saringer . | |
| 4,869,494 | 9/1989 | Lambert, Sr. | 482/60 |
| 5,108,090 | 4/1992 | Reed | 482/907 |
| 5,170,777 | 12/1992 | Reddy et al. . | |
| 5,179,939 | 1/1993 | Donovan et al. . | |
| 5,265,589 | 11/1993 | Wang . | |
| 5,277,681 | 1/1994 | Holt | 482/907 |
| 5,300,090 | 4/1994 | Primic | 601/26 |
| 5,335,649 | 8/1994 | Randall et al. | 601/24 |
| 5,343,856 | 9/1994 | Proctor . | |
| 5,419,752 | 5/1995 | James et al. . | |
| 5,421,801 | 6/1995 | Davies, III et al. . | |
| 5,500,002 | 3/1996 | Riddle et al. . | |
| 5,529,560 | 6/1996 | Davies, III et al. . | |
| 5,662,592 | 9/1997 | Brady | 601/34 |
| 5,769,766 | 6/1998 | Huang | 482/140 |

*Primary Examiner*—Danton D. DeMille
*Attorney, Agent, or Firm*—Oldham & Oldham Co., L.P.A.

[57] ABSTRACT

The present invention is directed to a complete body strengthening and stretching apparatus which relies on passive motion provided by a drive mechanism to direct the movement of the back, legs, arms and torso. The apparatus may include a support frame including a base adapted to rest on a floor and provided with a body support for supporting the user in a seated position. In the preferred embodiments, the support frame may include a back rest and seat, or further a body rest and a leg support surface for supporting and working of the lower body. An exercise bar is positioned in conjunction with the frame and is grippable by the user for stretching and exercising the upper body by means of movement of the exercise bar. A linear actuator is coupled to the frame and operates to cause movement of the exercise bar for imparting passive motion to the arms and upper body of the user. The exercise bar is operatively coupled to the linear actuator which includes a drive motor for providing a directional driving force to said linear actuator for at least raising and lowering of the exercise bar. There may also be associated with the apparatus a control system coupled to the linear actuator for translating control signals to control the direction or other aspects of the actuator operation. The bar may also be made to impart rotational motion to the upper body. In an embodiment of the invention, the frame may include an exercise seat and linkage mechanism coupled to the linear actuator and a leg support and extension mechanism so that extension of the exercise bar and the resulting raising of the arms above the head of the user corresponds to bending of the user's legs as in a deep knee bend or conventional squatting exercise. A control system may be used in conjunction with the control interface or preset to control the direction, speed, extension of the arms or legs or other aspects of operation. Adjustment of the linear actuator operation controls the degree and speed of extension and contraction of the various body parts by extending the actuator at a set speed and only to a predetermined stop point. Alternatively, the user manually controls the degree of extension through a hand- or foot-operated controls.

4 Claims, 3 Drawing Sheets

ACTUATOR DRIVEN STRETCHING AND EXERCISE DEVICE

BACKGROUND OF THE INVENTION

1. Technical Field

The present invention relates generally to a passive body stretching and exercise device and more particularly to an actuator-driven machine which can be used for whole body stretching and strengthening, particularly of the arms, legs and back to improve or maintain physical fitness and agility and/or aid in the physical rehabilitation of the user.

2. Description of Related Art

It is desirable in maintaining physical fitness and agility to ensure proper range of motion for various muscle groups and body segments. This becomes important not only for increasing strength and fitness in an exercise program, but also for physical rehabilitation or maintenance, particularly in older adults. As people age, it is known that physical mobility tends to decrease, sometimes to the point that movements become impaired and restricted. Stretching of muscles, ligaments, tendons and other body parts becomes essential for maintaining agility and full range of motion in such individuals, and thereby increases mobility and use of specific body parts. Similarly, in an exercise program to develop increased strength and body conditioning, it is important as an aspect of the program to properly stretch various muscle groups and the like to avoid injury during exercising. Although stretching is usually performed by standing or sitting on the floor and manually conducting stretching exercises, it would be desirable to have an apparatus which can aid in providing proper stretching and or facilitate stretching exercises for older or injured persons.

Exercise devices which rely on a driving means other than the individual for bringing about the desired motions are referred to generally as "passive" exercisers. Passive exercise equipment is many times designed for the rehabilitation specific areas of the body, and are used by handicapped or injured persons, including patients recovering from strokes or head injuries. Increased blood circulation, muscle tone and range of motion are recognized benefits of a rehabilitation program which incorporates a form of passive exercise. By simulating the operation of muscles and joints, passive exercise compels a patient to perform an exercise correctly without the constant supervision of a physical therapist.

Further, passive exercise devices have found application to the rehabilitation of joints especially those of the shoulder. One significant feature of shoulder therapy is the "continuous" nature of the motion around the joint required for proper rehabilitation. Passive motion devices allow the shoulder to follow its natural range of motion while minimizing stresses on the joint and muscles. Passive motion devices designed to combine shoulder rotation with other arm or torso motions are also known.

Passive motion devices, such as spinal therapy tables are also known which are capable of positioning a patient's spine for therapy through the motor-driven raising and lowering of segments of a therapy table. Again, these devices operate on a specific portion of the body and are designed to ensure proper movement of a specific muscle group through passive movement.

Currently available passive motion exercise and stretching devices do not adequately allow the user to make the combination of stretching and strengthening motions. Most existing devices are designed to isolate body parts for specific therapeutic motions. Known devices do not adequately combine stretching and strengthening for a number of major body parts simultaneously and typically are not easy and effectively used by all varieties of users for stretching and/or exercise. An apparatus which provides complete body strengthening and stretching and allows the user to make a comfortable combination of motions is needed and is currently unavailable.

SUMMARY OF THE INVENTION

The present invention is directed to a complete body strengthening and stretching apparatus which relies on passive motion provided by a drive mechanism to direct the movement of the back, legs, arms and torso. The present invention comprises a support frame including a base adapted to rest on a floor and provided with a body support for supporting the user in a seated position. In the preferred embodiments, the support frame may include a back rest and seat, or further a body rest and a leg support surface for supporting and working of the lower body. An exercise bar is positioned in conjunction with the frame and is grippable by the user for stretching and exercising the upper body by means of movement of the exercise bar. A linear actuator is coupled to the frame and operates to cause movement of the exercise bar for imparting passive motion to the arms and upper body of the user. The exercise bar is operatively coupled to the linear actuator which includes a drive motor for providing a directional driving force to said linear actuator for at least raising and lowering of the exercise bar. There may also be associated with the bar a control interface such as a lever coupled to the linear actuator for translating user control signals to control the direction or other aspects of the actuator operation. The bar may also be made to impart rotational motion to the upper body. In an embodiment of the invention, the frame may include an exercise seat and linkage mechanism coupled to the linear actuator and a leg support and extension mechanism so that extension of the exercise bar and the resulting raising of the arms above the head of the user corresponds to bending of the user's legs as in a deep knee bend or conventional squatting exercise. A control system may be used in conjunction with the control interface or preset to control the direction, speed, extension of the arms or legs or other aspects of operation. Adjustment of the linear actuator operation controls the degree and speed of extension and contraction of the various body parts by extending the actuator at a set speed and only to a predetermined stop point. Alternatively, the user manually controls the degree of extension through a hand- or foot-operated controls.

The exercise device of the present invention includes a mechanism for rotating both the exercise bar as well as the seat so that stretching and strengthening of the torso and stomach muscles can be accomplished by twisting the torso during raising and lowering of the exercise bar. The apparatus is also capable of exercising the shoulders and back as well as exercising the thighs and buttocks by varying the manner in which the passive motion is resisted.

Accordingly, one object of the present invention is to provide an exercise and stretching apparatus which simultaneously controls the movement of a variety of body parts while allowing the user to alternatively yield and resist to the passive motion of the body parts controlled by a drive mechanism.

The above and other objects, features and advantages of the present invention will become apparent from the following description read in conjunction with the accompanying drawings, in which like reference numerals designate the same elements.

DESCRIPTION OF THE PREFERRED EMBODIMENTS

Figure 1:
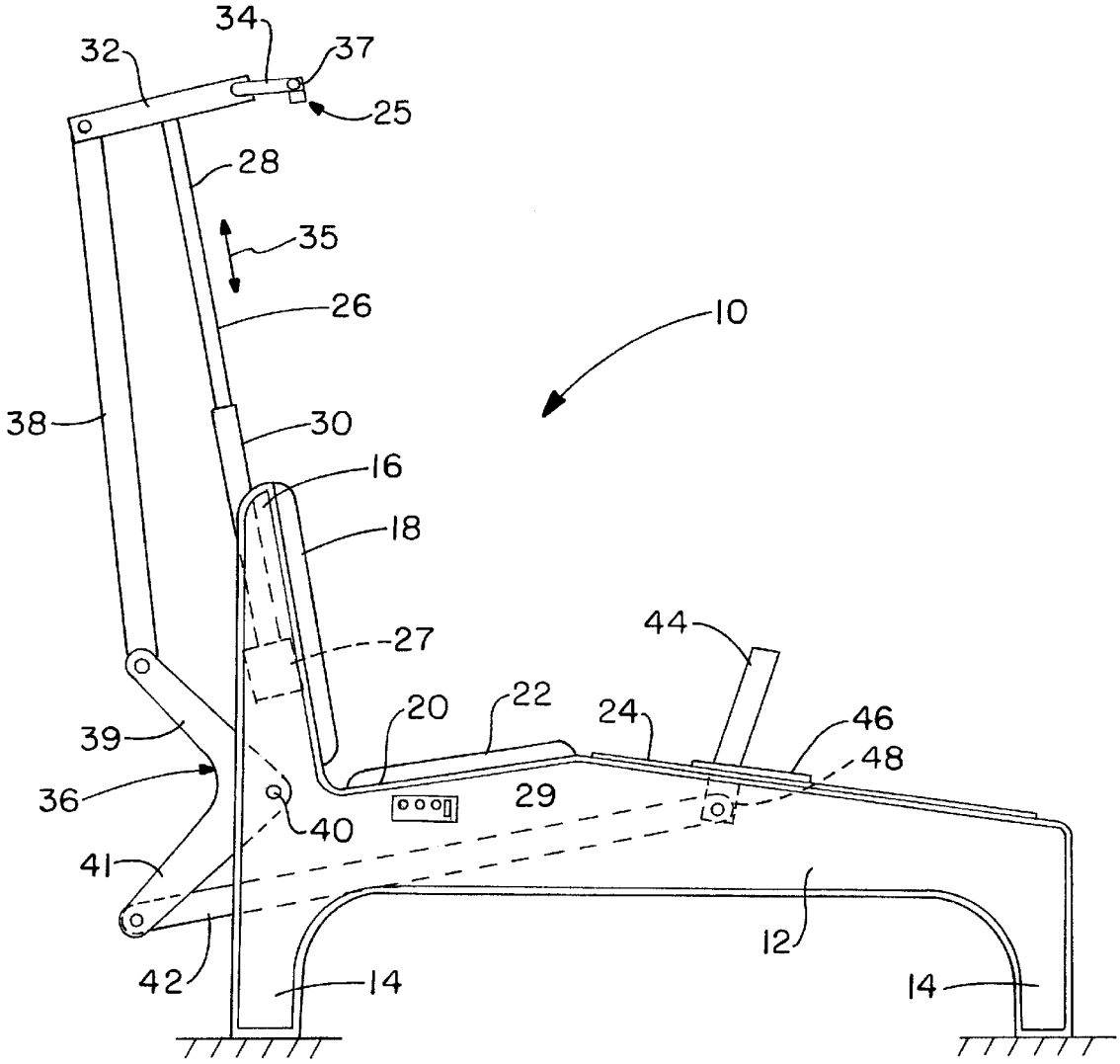
FIG. 1 is a side elevational view of a stretching and exercise device in accordance with a first embodiment of the present invention.

Referring now to the drawings and in particular to FIG. 1, there is shown a side elevational view of a first preferred embodiment of a stretching and exercise device 10 of the present invention. The device includes a support frame 12 made from plastic, steel or similar sturdy material including leg members 14 resting on the floor or other support surface. Frame 12 may be designed in a conventional bench configuration, and may include a back rest 16 equipped with pad 18 and seat 20 with pad 22 for supporting the back and buttocks of the user respectively. Frame 12 may also include a leg support surface 24 to position and support the legs and for engaging a component of the device for exercising and stretching the legs as described below. FIG. 1 depicts a reclining configuration for the back rest 16 and body rest 20; although this is the preferred positioning of the user, it is also understood that the invention encompasses a device in which the back rest 16 and seat 20 are otherwise positioned. Likewise, the body rest 20 and leg support surface 24 may be a single surface rather than two separate surfaces as shown in FIG. 1.

Associated with the frame 12 is an exercise bar 34 extending above the seat 20 and backrest 16 so as to be grasped by a person seated in seat 20. The exercise bar 34 is coupled to an extension bar or actuator bar 28 which extends upward from back rest 16. A drive mechanism, generally indicated at 26 is associated with the actuator bar 28, and may include a drive motor 27 positioned within the frame 12. The drive mechanism 26 provides the driving force for the passive motion of the various body exercising and stretching components of the apparatus. The drive mechanism 26 and associated actuator bar 28 is preferably of the commercially available type of linear actuator comprising a motor driven gear (not shown) which in turn drives a screw actuator or actuator bar 28 within an associated actuator tube 30. As an example of a suitable mechanism, a commercially available modular AC linear actuator is available through Dayton Manufacturing, Serial No. 6Z088, or the like, with the design of the linear actuator matched to the performance criteria of the apparatus. Alternatively, the drive mechanism could be a hydraulic or pneumatic mechanism operating as an actuator. It is essential only that a drive mechanism 26 operates to move the actuator bar 28 relative to the frame 12 or position of the user in seat 20, preferably in extension and rotating modes of operation.

Actuator 28 acts as a push rod for moving the exercise bar 34 in a direction as shown by the arrow 35 to raise and lower the bar 34 relative to the position of the user. As should be recognized, the raising and lowering of the exercise bar 34 will correspondingly cause raising and lowering of the users arms as they grasp the bar 34. It should also be recognized that as the users arms are raised and lowered along with the exercise bar 34, the arms and back of the user will be stretched to a degree corresponding to the length of travel of the linear actuator and particularly the actuator bar 28. Again, the actuator bar 28 is preferably positioned so that when the user grasps the exercise bar 34, the extension of the actuator bar 28 will provide movement of the arms and upper body in a manner consistent with the normal extension of these body parts in order to effectively stretch the arms, back and torso of the user. Preferably, the exercise bar 34 includes two outwardly and slightly forwardly extending handles 37 which can be grasped by the user, similar to other types of exercise equipment such as with weight lifting apparatus. If desired, Velcro straps (not shown) or the like can be provided with the handles 37 to facilitate grasping of the handles if necessary. The operation and control of the drive mechanism 26 may be user controlled or preset for particular operation modes to achieve flexibility and ease of use. The control functions will be described in more detail hereafter. In operation, actuator bar 28 passively extends the arms of the user above the head in a motion similar to that of a pressing exercise or in normal raising and lowering of the arms. The length of travel of actuator bar 28, which can be adjusted manually or automatically to control the direction and stop points of the motion in order to accommodate the degree of stretching or exercise desired by the user or preset by the control system. It is to be understood that the upper body motion created by drive means 26 can be used as a stretching exercise by passively grasping the exercise bar 34, but can also be used in strengthening exercises when the motion of bar 34 is resisted by the user, both as the bar 34 moves upwardly and downwardly. The control system may also vary the operation of the actuator to facilitate exercising using the apparatus, by varying the speed, direction and/or rotation of the bar 34.

Also in this preferred embodiment, the actuator bar 28 associated with the drive mechanism 26 is particularly coupled to a linkage system for also controlling operation of a leg stretching and exercise component of the apparatus 10. The linkage system may include a first support member 32, which in this embodiment also carries the exercise bar 34 in conjunction therewith, and is raised or lowered in conjunction with the movement of actuator bar 28. Exercise bar 34 may simply include outwardly extending handles which extend in a direction substantially perpendicular to first support member 32 providing the means for the user to grip the device with one or both hands. Alternatively, exercise bar 34 may be a separate integral component having two outwardly extending handles coupled to support member 32, and may be rotatably or pivotally connected to member 32 in a manner which allows rotation of exercise bar 34 about an axis for the stretching and strengthening of the torso and stomach muscles by twisting the torso during raising and lowering of exercise bar 34. Alternative methods of allowing or promoting such twisting or rotation of the upper body are also contemplated. In order for the single drive mechanism 26 to bring about all of the desired passive motions, the force of linear actuator bar 28 must be translated through the linkage system or appropriate translation means into at least one other directional force for bringing about at least one other passive body movement. A preferred linkage system is depicted in FIG. 1 as including an angled lever arm 36 coupled to the first support member 32 through first coupling member 38. The first coupling member 38 is pivotally connected at one end to member 32 and at its other end to lever arm 36, and exerts a force on one arm 39 of lever 36. The force exerted by member 38 causes angled lever arm 36 to rotate about its pivot point 40 thereby changing the direction of the force and translating it to a second arm 41. The force translated through angled lever arm 36 is transferred via a second coupling member 42 pivotally coupled to arm 41 and thereafter to a second passive motion component of device 10.

As shown in FIG. 1 a second passive motion component is preferably a leg extension mechanism. The leg extension mechanism depicted in FIG. 1 comprises a foot plate 44 rigidly attached to a movable platform 46. An attachment member 48 extending from a lower surface of platform 46 provides a means for associating the motion of foot plate 44 with the movement of member 42. As member 42 extends, platform 46 moves away from the user along a channel or track in leg support surface 24. Again, straps or other foot retaining means may be used in conjunction with foot plate 44 to bind the feet of the user thereto, and the user may passively extend his/her legs with the movement of platform 46 as a stretching exercise. Movement of the foot plate 44 may again be resisted in both extending and contracting cycles of the foot plate 44 for strengthening. It should be recognized that the present invention is not limited to the rehabilitation and stretching of patients. By the user applying a resistance to the passive motion imparted by the actuator, the device can also be used as a muscle strengthening apparatus as part of a physical fitness or conditioning program. A device used in such a way not only provides the benefits of stretching and flexibility as the motion is made in one direction by the passive driving means, but also allows the user to develop strength by resisting the return motion in the opposite direction. A strengthening device of this type has the additional advantage of insuring that the user performs the resisting motion in the direction and with the proper form so as to avoid injury or unnecessary stress to the joints and muscles.

Figure 2:
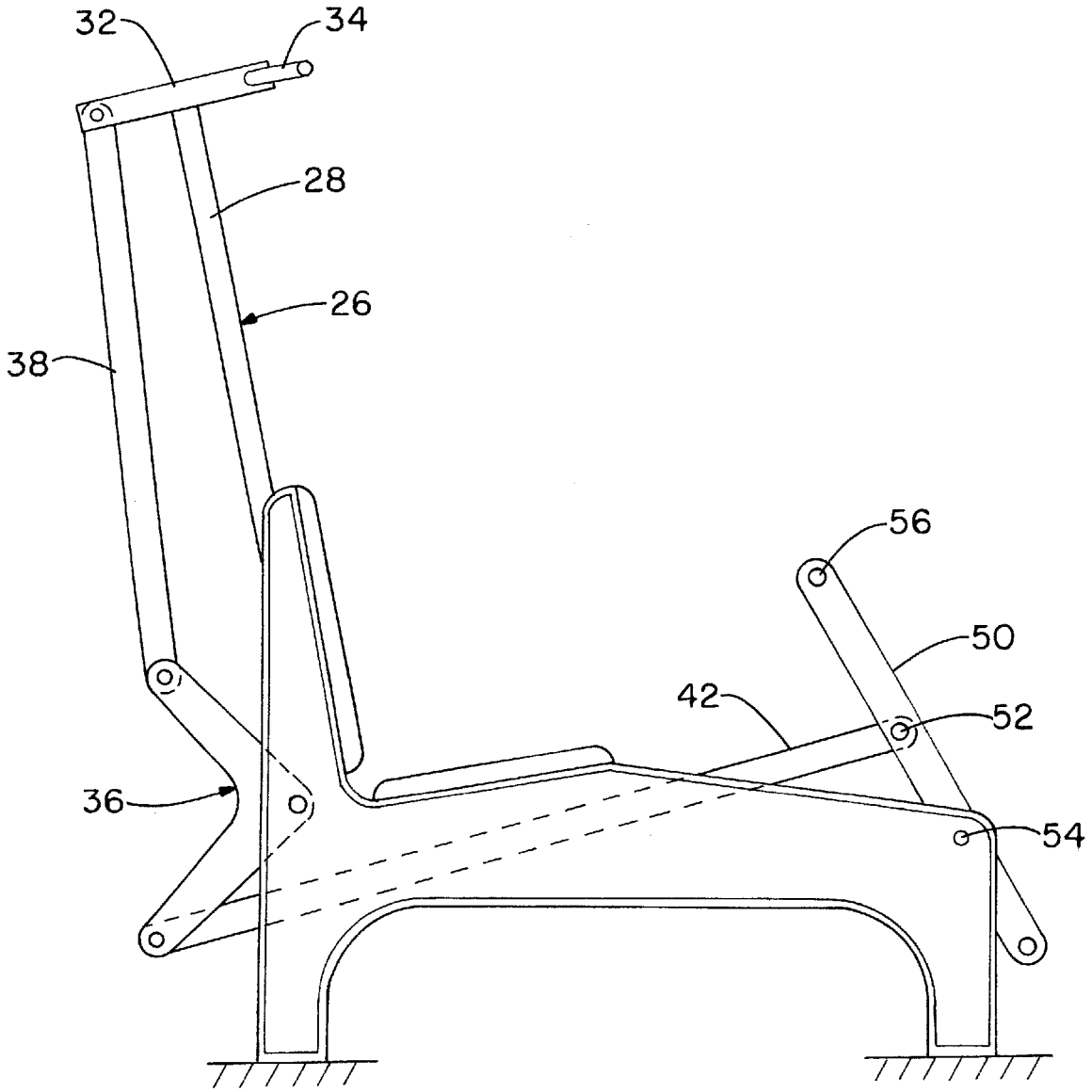
FIG. 2 is a side elevational view of an alternative embodiment of a stretching and exercise device in accordance with the present invention.

An alternative embodiment of the leg extension mechanism is shown schematically in FIG. 2. In this embodiment, those elements which have not been identified particularly may be similar to that described with reference to FIG. 1. In this embodiment, a leg extension or squat-simulated exercise and stretching is accomplished by motion driven by member 42. Member 42 is pivotally connected to lever 50 along rod 52 so that extension of member 42 causes pivoting about fulcrum 54. The pivoting of lever 50 results in the extension and contraction of foot bar 56 away from and toward the user, respectively. The user's feet engage foot bar 56 as in a conventional foot press, or may be extended over the foot bar 56 to allow the muscles in the back of the leg to be stretched or exercised. Again, the user may extend and contract the legs with the passive motion of the foot bar 56, or may resist the motion of the foot bar 56 to allow further exercise.

Returning to FIG. 1, the extent and speed of the movement of actuator bar 28 will control the degree of stretching and/or exercise available to the user. A user-activated control system 25 or automatic control system 29, capable of controlling functions of the drive mechanism 26 is provided. A user interface 31 may be provided in conjunction with control system 29 to allow the user to program the control system 29 to perform desired functions. In the preferred embodiment, the control system, either 25 or 29, may be used to reverse direction of travel of the actuator bar 28, and thereby control movement and reverse direction of the passive motion components of the device. The degree of travel can also be fixed or actively controlled by the control systems. The final height of screw actuator 28 can be manually preset before operation so that the height is optimal for the user, or a user interface associated with the user control system 25 can be used to actively control this extent. The apparatus may also have an automatic mechanism for controlling the ultimate height of actuator bar 28 to ensure that the user is not overstretched by movement of the exercise bar 34 and/or footplate 44. The actuator bar 28 and drive mechanism 26 may be configured to terminate operation of the drive mechanism if the user interface 31 is actuated, or if a certain event would occur during operation of the apparatus. To protect the user from overstretching or the like, the drive mechanism can be controlled by the control system to automatically reverse direction or stop operation if a predetermined amount of weight is placed on the exercise bar 34 and/or footplates 44 by the user. Thus, if the extent of travel of the actuator bar 28 is not properly set by the control system, as the actuator bar 28 extends, and the users arms and legs are stretched by motion of the exercise bar 34 and/or footplates 44, if the degree of stretching results in excessive weight placed upon these portions of the apparatus, the control system will automatically terminate or reverse direction of the actuator bar 28. As an example, the automatic mechanism may be a clutch associated with the actuator 28 which will engage upon a predetermined weight being applied to the exercise bar 34. Another mechanism to monitor the torque or other variable in the case of screw actuators or pressure in the case of hydraulic or pneumatic actuators to automatically control operational characteristics of the apparatus are contemplated in the invention. Control over the length or distance of the exercise motion in this way provides the user with a means for controlling the range of motion rather than the degree of resistance required as with a conventional exercise device. The amount of resistance is independent of the passively controlled motion which will continue with or without resistance by the user. Alternatively, the degree of resistance may be preset or actively controlled to control the exercise performed by the user. Additionally, other functions of the actuator may be controlled, such as speed of operation, to gain a variety of functional and adaptable characteristics to tailor operation of the apparatus to the user. The control system 25 or 29 may for example be used to control a predetermined cycle of operation which may include both stretching and/or exercising activities. For example, operation of the actuator may be controlled to vary the speed of movement either upwardly or downwardly at different rates through a cycle, which can allow the user to perform a system of movements designed to enhance range of motion or strength and agility. As movement of the exercise bar 34 or footplates 44 can be resistant to perform exercise components of a system, varying the rate, direction and movement of the exercise bar 34 and/or footplate 44 can provide a series of motions which will allow different areas of the body to be worked upon in an operation cycle. It should be recognized that the user interface 31 could also include a variety of control components so the user may define a cycle of operation in use of the apparatus.

Figure 3:
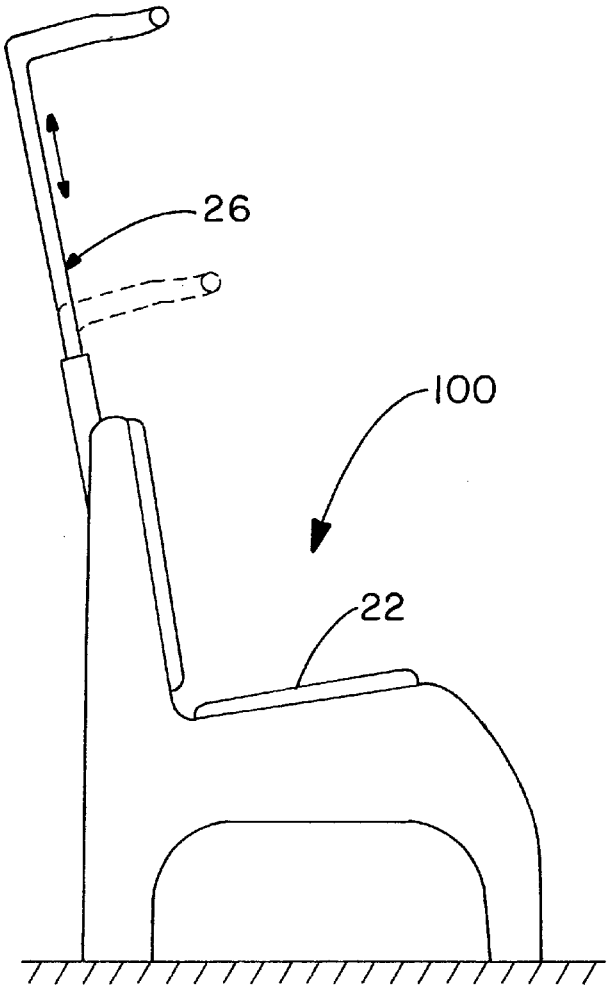
FIG. 3 is a side elevational view of a further embodiment of the invention.
Figure 4:
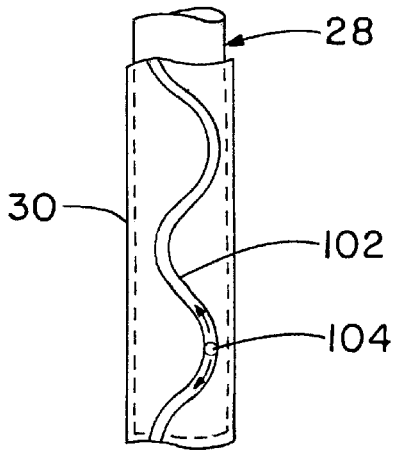
FIG. 4 is an enlarged partial side view of the actuator system.

In FIG. 3, a further alternative embodiment 100 is shown to include only an arm and upper body stretching and exercising component, without the corresponding leg and lower body component of the previous embodiments. It should also be recognized that a similar apparatus could be used when in the standing position, such that the seat portion of the frame may not be necessary. The apparatus 100 may be generally similar to that previously described with respect to construction and function of this component, and provides a very simple and effective upper body stretching and exercising apparatus which is cost effective and easily used by a variety of users, including older or injured persons. In addition, in this embodiment there may be provided a mechanism to cause rotation of the exercise bar 34 upon operation of the actuator in upward or downward movement of bar 34. As shown in FIG. 4, and with reference back to FIG. 1, the actuator bar 28 may be a linear actuator having an associated tube 30 in which actuator bar 28 is moveable. In this embodiment, extension and retraction of actuator bar 28 relative to tube 30 is provided, along with actuator bar 28 being rotatable around its longitudinal axis. In order to provide rotation of the upper torso of a user of the apparatus 10, a channel or track 102 may be provided in tube 30, and actuator bar 28 may have a guide 104 adapted to travel within track 102. As guide 104 follows track 102, relative rotation of actuator bar 28 to tube 30 occurs, in turn causing relative rotation of the exercise bar 34. It should be recognized that when the user grasps the exercise bar 34, this relative rotation will cause twisting about the torso, to stretch and/or exercise muscles associated with this region. Other mechanisms to allow rotation of the exercise bar 34 are contemplated in the invention, and the arrangement shown in FIG. 4 is merely an example of one possible mechanism. Depending on the type of actuator system, such a mechanism can be provided in any suitable manner. In addition, the seat portion 22 of the apparatus may be mounted so as to be rotatable relative to the frame to allow further twisting of the torso in use.

Although the preferred embodiments of the invention have been described in the foregoing DESCRIPTION OF THE PREFERRED EMBODIMENTS and illustrated in the accompanying drawings, it will be understood that the invention is not limited to the embodiments disclosed, but is capable of modification of parts and elements without departing from the spirit and scope of the invention.

What is claimed is:

1. A stretching and exercise apparatus, comprising:

a support frame positioned upon a supporting surface;

an exercise bar grippable by a user for stretching and exercising at least a portion of the upper body of the user, said exercise bar being supported upon said support frame;

and actuator coupled to said exercise bar for imparting at least passive motion to said exercise bar in a direction which is substantially vertical relative to said support frame;

a drive mechanism for providing a directional driving force to said actuator;

a control system associated with said actuator for controlling said drive mechanism and selectively causing movement of said exercise bar relative to said support frame; and, a linkage system coupled in operative engagement with said actuator, wherein said directional driving force imparted by said drive mechanism is translated by said linkage system into movement of at least one other mechanism for providing passive movement to at least one other portion of the user's body.

2. A stretching and exercise apparatus, comprising:

a support frame positioned upon a supporting surface;

an exercise bar grippable by a user for stretching and exercising at least a portion of the upper body of the user, said exercise bar being supported upon said support frame;

and actuator coupled to said exercise bar for imparting at least passive motion to said exercise bar in a direction which is substantially vertical relative to said support frame;

a drive mechanism for providing a directional driving force to said actuator;

a control system associated with said actuator for controlling said drive mechanism and selectively causing movement of said exercise bar relative to said support frame for providing at least passive body motion of said at least portion of the upper body; and, a leg stretching mechanism supported on said support frame, wherein said directional driving force imparted to said actuator is translated through a linkage system coupled between said actuator and said leg stretching mechanism to cause operation of said leg stretching mechanism.

3. An apparatus according to claim 2, wherein, said leg stretching mechanism includes a moveable platform having an upper surface and a lower surface, with a foot rest provided in association with said upper surface for engaging at least a foot of the user, wherein said moveable platform is coupled in association with said actuator to cause motion thereof relative to said support frame.

4. An apparatus according to claim 2, wherein said leg stretching mechanism comprises a foot bar for engaging at least a foot of the user, said foot bar including an extension pivotally attached to a fulcrum on said support frame, wherein said actuator causes rotation of said foot bar about said fulcrum to impart passive motion thereto.

* * * * *